US010563652B2

(12) United States Patent
De Andrade Filho et al.

(10) Patent No.: US 10,563,652 B2
(45) Date of Patent: Feb. 18, 2020

(54) VARIABLE DISPLACEMENT VANE PUMP

(71) Applicant: Melling Tool Company, Jackson, MI (US)

(72) Inventors: Ayres Pinto De Andrade Filho, Jackson, MI (US); João Luiz De Carvalho Meira, Santo André (BR); Eduardo Gubbiotti Ribeiro, Ribeirao Pires (BR)

(73) Assignee: Melling Tool Company, Jackson, MI (US)

( * ) Notice: Subject to any disclaimer, the term of this patent is extended or adjusted under 35 U.S.C. 154(b) by 64 days.

(21) Appl. No.: 15/326,561

(22) PCT Filed: Jul. 18, 2014

(86) PCT No.: PCT/US2014/047150
§ 371 (c)(1),
(2) Date: Jan. 16, 2017

(87) PCT Pub. No.: WO2016/010551
PCT Pub. Date: Jan. 21, 2016

(65) Prior Publication Data

US 2017/0198692 A1 Jul. 13, 2017

(51) Int. Cl.
*F04C 14/22* (2006.01)
*F04C 2/344* (2006.01)
(Continued)

(52) U.S. Cl.
CPC ..... *F04C 14/226* (2013.01); *F04C 2/344* (2013.01); *F04C 14/24* (2013.01); *F04C 15/06* (2013.01);
(Continued)

(58) Field of Classification Search
CPC ..... F04C 14/22; F04C 14/24; F04C 14/26; F04C 14/226; F04C 2/344; F04C 2/3442
(Continued)

(56) References Cited

U.S. PATENT DOCUMENTS 4,570,662 A * 2/1986 Anderson ..... B62D 5/06 137/115.1
5,518,380 A * 5/1996 Fujii ..... F04C 14/226 418/26
(Continued)

FOREIGN PATENT DOCUMENTS

EP 2 253 847 A1 11/2010
GB 2 466 274 A 6/2010
WO 2013038221 A1 3/2013

OTHER PUBLICATIONS

International Search Report from the European Patent Office dated Sep. 9, 2014 for PCT Patent Application No. PCT/US2014/047150.

*Primary Examiner* — Deming Wan
(74) *Attorney, Agent, or Firm* — Young Basile Hanlon & MacFarlane, P.C.

(57) ABSTRACT

A variable displacement vane pump includes a biasing element for urging the control ring toward a first position that corresponds to a maximum volumetric capacity of the pump. Fluid pressure within a control chamber urges the control ring toward the second position. A feedback path is in communication with a fluid outlet of the pump for supplying a pressurized fluid. A first supply path provides the pressurized fluid to the fluid inlet. A second supply path provides the pressurized fluid to the control chamber. A valve controls flow of the pressurized fluid via the second supply path by moving between a fully open position and a fully closed position in which flow of the pressurized fluid along the second supply path is prevented by the valve. Moving the valve from the open position to the closed
(Continued)

position increases the fluid pressure within the control chamber.

20 Claims, 6 Drawing Sheets

(51) Int. Cl.
*F04C 14/24* (2006.01)
*F04C 14/26* (2006.01)
*F04C 15/06* (2006.01)

(52) U.S. Cl.
CPC .... *F04C 2210/206* (2013.01); *F04C 2240/20* (2013.01); *F04C 2240/30* (2013.01)

(58) Field of Classification Search
USPC ..... 418/22, 27, 30, 24, 68, 61, 263, 266
See application file for complete search history.

(56) References Cited

U.S. PATENT DOCUMENTS

| | | | | |
|---|---|---|---|---|
| 9,638,189 | B2 * | 5/2017 | Miyajima | F04C 14/226 |
| 2010/0028171 | A1 * | 2/2010 | Shulver | F01M 1/16 417/307 |
| 2013/0209302 | A1 | 8/2013 | Ono et al. | |
| 2014/0147322 | A1 * | 5/2014 | Saga | F04C 2/344 418/24 |
| 2014/0147323 | A1 * | 5/2014 | Watanabe | F04C 2/3442 418/27 |

* cited by examiner

VARIABLE DISPLACEMENT VANE PUMP

TECHNICAL FIELD

This disclosure relates to the field of variable displacement vane pumps, and more particularly, to a pump in which a displacement adjusting structure can be moved to alter the volumetric capacity of the pump.

BACKGROUND

Variable displacement vane pumps are well-known and can include a displacement adjusting structure in the form of a pump control ring that can be moved to alter the rotor eccentricity of the pump and hence alter the volumetric capacity of the pump. If the pump is supplying a system with a substantially constant orifice size, such as an automobile engine lubrication system, changing the output volume of the pump is equivalent to changing the pressure produced by the pump.

Having the ability to alter the volumetric capacity of the pump to maintain an equilibrium pressure is important in environments such as automotive lubrication pumps, in which the pump will be operated over a range of operating speeds. In order to maintain an equilibrium pressure in such environments, it is known to utilize a feedback supply of the working fluid (e.g., lubricating oil) from the output of the pump to a control chamber adjacent the pump control ring, the pressure in the control chamber acting to move the control ring, typically against a biasing force from a return spring, to alter the capacity of the pump.

When the pressure at the output of the pump increases, such as when the operating speed of the pump increases, the increased pressure is applied to the control ring to overcome the bias of the return spring and to move the control ring to reduce the capacity of the pump, thus reducing the output volume and hence the pressure at the output of the pump.

Conversely, as the pressure at the output of the pump drops, such as when the operating speed of the pump decreases, the decreased pressure applied to the control chamber adjacent the control ring allows the bias of the return spring to move the control ring to increase the capacity of the pump, raising the output volume and hence pressure of the pump. In this manner, an equilibrium pressure is obtained at the output of the pump. The equilibrium pressure is determined by the area of the control ring against which the working fluid and the control chamber acts, the pressure of the working fluid supplied to the chamber, and the bias force generated by the return spring.

Conventionally, the equilibrium pressure is selected to be a pressure which is acceptable for the expected operating range of the engine and is thus somewhat of a compromise, as, for example, the engine may be able to operate acceptably at lower operating speeds with a lower working fluid pressure than is required at higher operating engine speeds. To prevent undue wear or other damage to the engine, the engine designers will select an equilibrium pressure for the pump which meets the worst case (high operating speed) conditions. Thus, at lower speeds, the pump will be operating at a higher capacity than necessary for those speeds, wasting energy pumping the surplus, unnecessary, working fluid.

SUMMARY

Variable displacement vane pumps are described herein.

One aspect of the disclosed embodiments is a variable displacement vane pump having a housing with a pump chamber having a fluid inlet and a fluid outlet. A pump control ring is disposed within the housing for altering the displacement of the pump by rotating between a first position that corresponds to a maximum volumetric capacity of the pump and a second position that corresponds to a minimum volumetric capacity of the pump. A vane pump rotor is rotatably mounted within the pump control ring. The vane pump rotor has a plurality of slidably mounted vanes engaging an inside surface of the pump control ring. The vane pump rotor has an axis of rotation eccentric from a center of the pump control ring. The vane pump rotor rotates to pressurize fluid as the fluid moves from the fluid inlet to the fluid outlet. The pump includes a biasing element for urging the control ring toward the first position and a control chamber formed between the housing and the pump control ring, wherein fluid pressure within the control chamber urges the control ring toward the second position. A feedback path in communication with the fluid outlet for supplying a pressurized fluid, a first supply path in communication with the feedback path and the fluid inlet for providing the pressurized fluid from the feedback path to the fluid inlet, and a second supply path in communication with the feedback path and the control chamber for providing the pressurized fluid from the feedback path to the control chamber. The pump includes a valve for controlling flow of the pressurized fluid via the second supply path. The valve moves between a fully open position in which flow of the pressurized fluid along the second supply path is not restrained by the valve, and a fully closed position in which flow of the pressurized fluid along the second supply path is prevented by the valve. Moving the valve from the open position to the closed position increases the fluid pressure within the control chamber.

In some implementations the valve is a non-proportional valve. In some implementations, the valve is normally-open. In some implementations, the valve is a proportional valve that is operable to define a range of positions between the fully open position and the fully closed position.

In some implementations the pressurized fluid is supplied to the control chamber at a pressure that is less than an outlet pressure of the pump and greater than an inlet pressure of the pump.

In some implementations the pump includes a restrictor element that receives the pressurized fluid from the feedback path and causes the pressure of the pressurized fluid to drop before it reaches the first supply path and the second supply path. In some implementations the restrictor element includes a calibrated orifice. In some implementations the restrictor element is located downstream from the feedback path, the second supply path is located downstream from the restrictor element, the valve is located downstream from the second supply path, and the first supply path is located downstream from the valve.

In some implementations the valve is an electronically-controlled valve. In some implementations the pump includes a controller that is in electrical communication with the valve for providing a control signal to the valve.

In some implementations, the biasing element is a spring. In some implementations, the biasing element is located in a spring chamber formed between the housing and the pump control ring. In some implementations, the control ring includes a regulating member that extends outward from a generally circular portion of the control ring, the regulating member having a first side that faces the control chamber and a second side that faces the spring chamber. In some implementations, the fluid pressure in the control chamber urges the control ring toward the second position by acting on the second side of the regulating member. In some implementations, the biasing element urges the control ring toward the first position by engaging the first side of the regulating member.

BRIEF DESCRIPTION OF THE DRAWINGS

The various features, advantages and other uses of the present apparatus will become more apparent by referring to the following detailed description and drawing in which.

DETAILED DESCRIPTION

Figure 1:
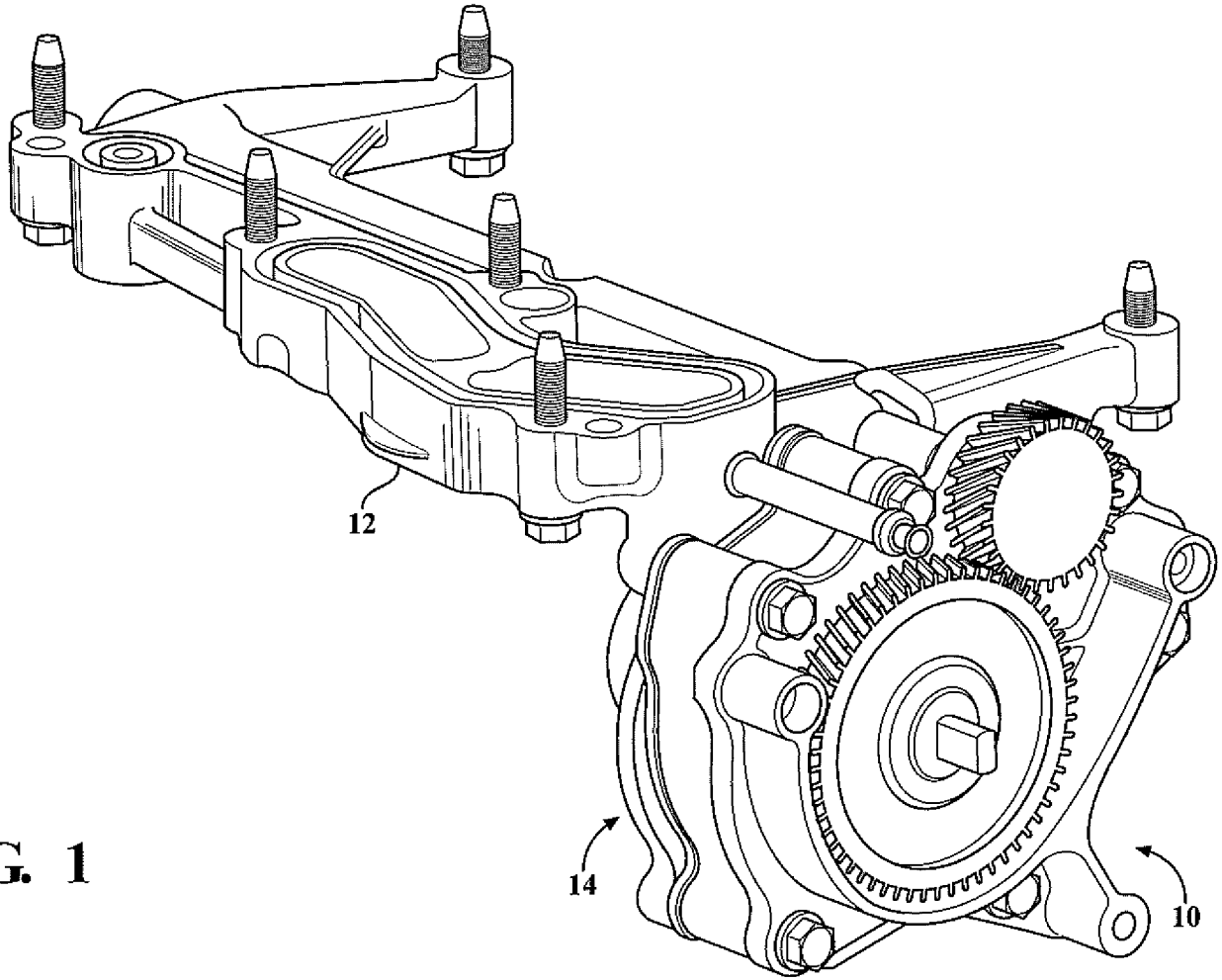
FIG. 1 is a perspective view showing a variable displacement vane pump and an automotive oil sump reservoir.
Figure 2:
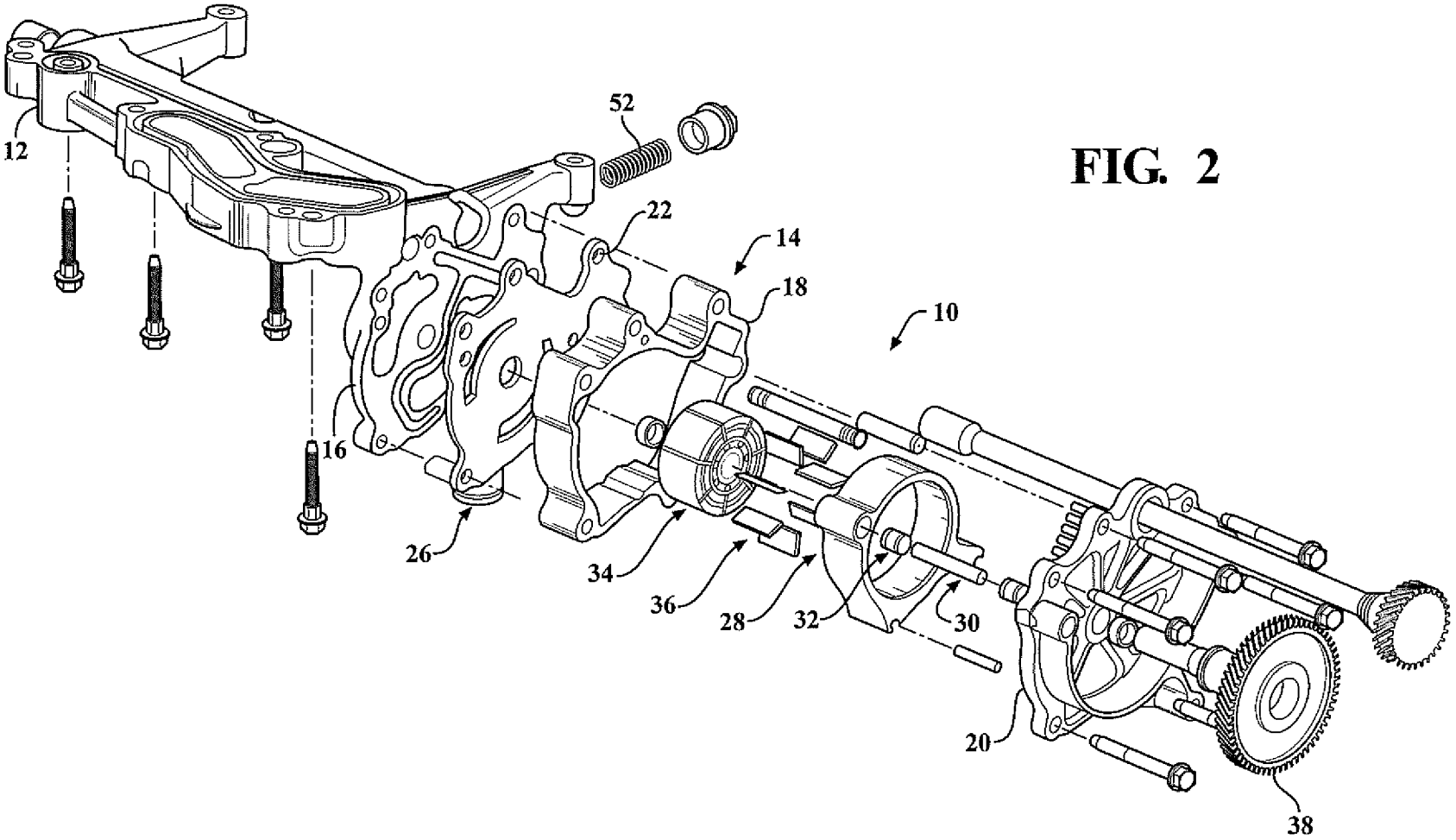
FIG. 2 is an exploded perspective view showing the variable displacement vane pump and the automotive oil sump reservoir of FIG. 1.

FIGS. 1-2 show a pump 10, which is a variable displacement vane pump. The pump 10 may be utilized to pump a fluid, such as automotive engine lubricant.

In the illustrated example, the pump 10 is a variable displacement vane pump. In automobile engine applications, the pump 10 can be connected to an oil sump reservoir 12. A housing 14 of the pump 10 can include a back side 16, a midsection 18, a cover 20, and a plate 22. The midsection 18 forms the peripheral walls of the housing 14, in which pumping and control chambers are formed, as will be explained herein. The cover 20 is connected to and sealed to the midsection 18. The back side 16 of the housing defines fluid flow paths for the pump 10 to allow fluid to enter and exit the pump 10. The plate 22 is mounted between the back side 16 and the midsection 18 of the housing 14 and includes apertures that define locations where fluid can pass between the back side 16 of the housing 14 and the chambers defined within the midsection 18 of the housing 14.

A pump control ring 28 is pivotally connected to the housing 14 by a pivot pin 30 and, optionally, a needle bearing 32. A vane pump rotor 34 is mounted within the pump control ring 28. The vane pump rotor 34 has a plurality of vanes 36 that are mounted for sliding within slots that are formed in the vane pump rotor 34. The vane pump rotor includes a ring 35. The vanes 36 pass through openings formed in the ring 35 and are engaged by the ring 35 such that rotation of the ring 35 causes rotation of the vanes 36. Although a single ring 35 is shown, some implementations include two or more rings to help keep the vanes 36 in contact with the pump control ring 28, especially at low speeds. The vanes 36 engage an inside surface of the pump control ring 28, and the vanes 36 slide within the slots in response to movement of the pump control ring 28 with respect to the vane pump rotor 34. The vane pump rotor 34 has an axis of rotation that is eccentric from a center of the pump control ring 28, as will be described further herein. A drive shaft 38 is driven by any suitable means, such as an automotive engine or other mechanism to which the pump is to supply working fluid to operate the pump 10. The drive shaft 38 engages the vane pump rotor 34 and rotates the vane pump rotor 34 as the drive shaft 38 is driven.

Figure 3:
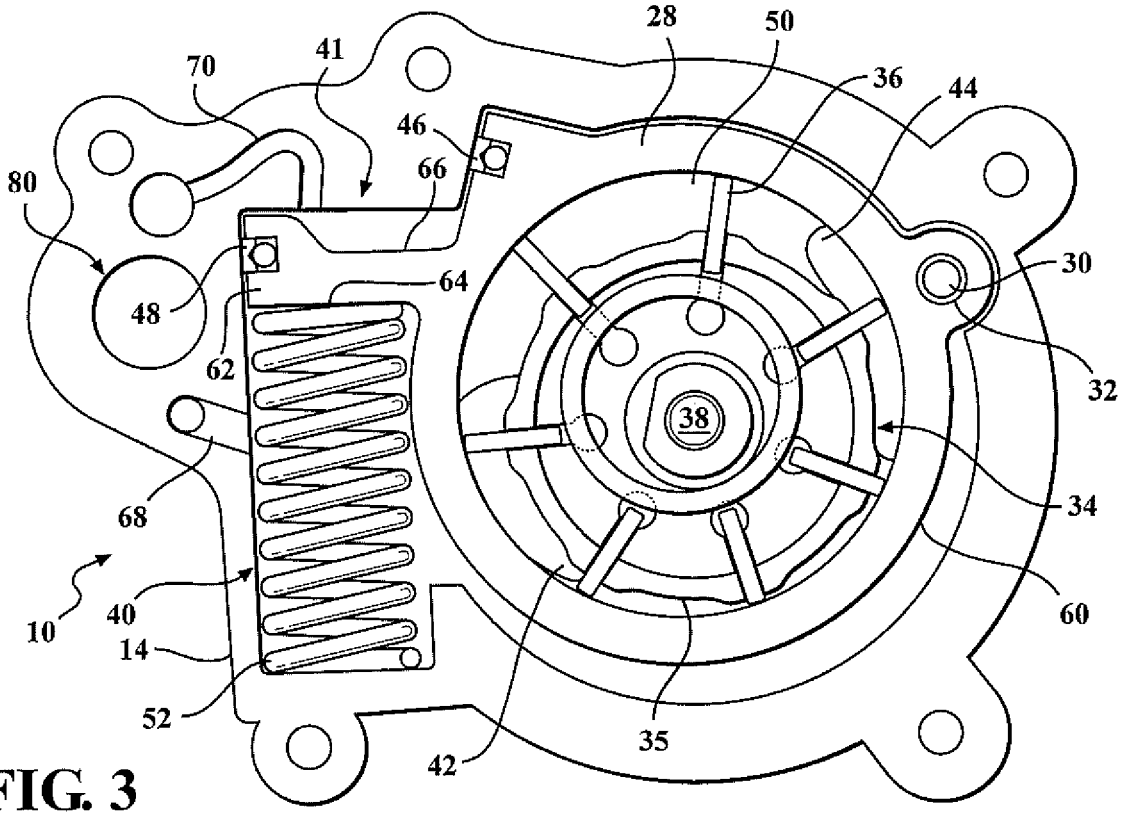
FIG. 3 is an illustration showing a control ring of the variable displacement vane pump in a first position that corresponds to a maximum volumetric capacity of the pump.
Figure 4:
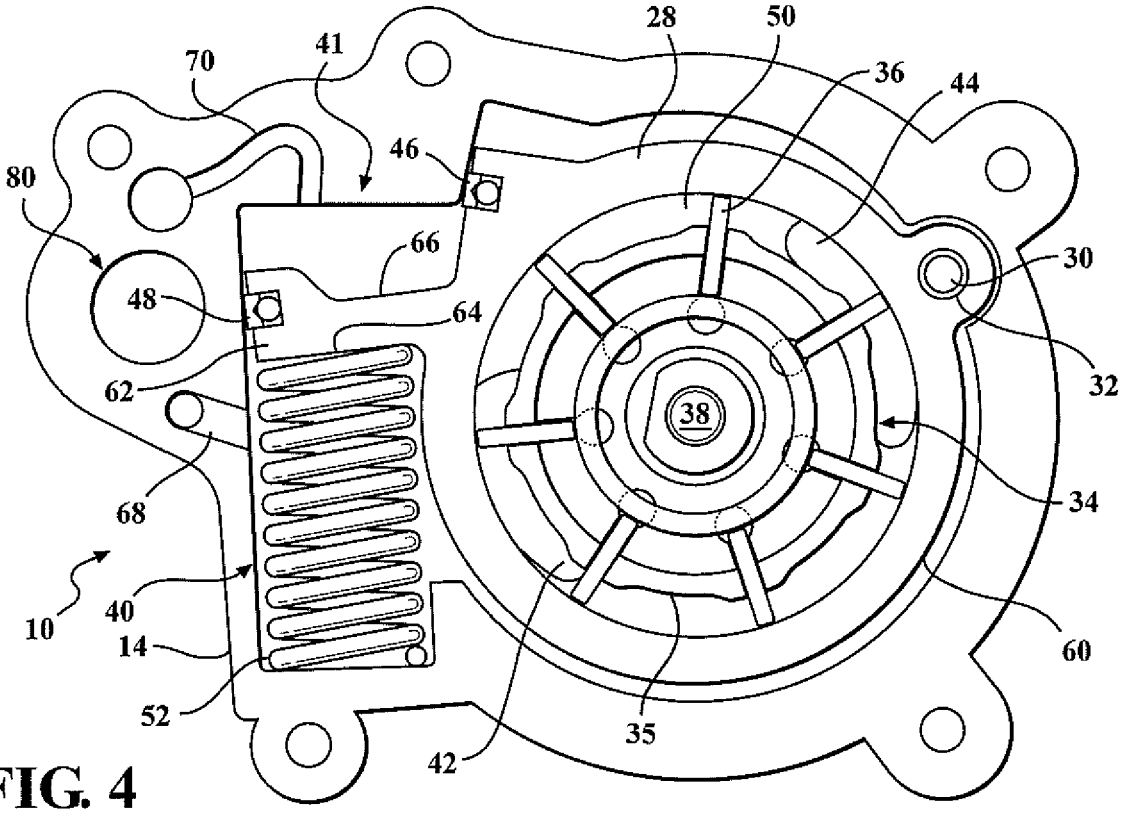
FIG. 4 is an illustration showing a control ring of the variable displacement vane pump in a second position that corresponds to a minimum volumetric capacity of the pump.

As seen in FIGS. 3-4, the pump control ring 28 includes a generally circular portion 60 and a regulating member 62 that extends outward from the circular portion 60. The regulating member 62 can include a first side 64 and a second side 66 that are opposite one another.

The pump control ring 28 is mounted within the housing 14 via the pivot pin 30. In particular, the pivot pin extends through an aperture that is formed near an outer periphery of the generally circular portion 60 of the pump control ring 28. This allows the center of the pump control ring 28 to move relative to the center of the vane pump rotor 34 as the pump control ring 28 pivots about the pivot pin 30. The needle bearing 32 is mounted between the pivot pin 30 and the pump control ring 28 so as to provide easy pivoting of the pump control ring 28 relative to the pivot pin 30. The center of the pump control ring 28 is located eccentrically with respect to the center of the vane pump rotor 34, as both the interior of the pump control ring 28 and the vane pump rotor 34 are substantially circular in shape.

The pump control ring 28, the vane pump rotor 34 and the vanes 36 cooperate to define working chambers 50 that are located between successive pairs of the vanes 36. Pumping from a fluid inlet 42 of the pump 10 to a fluid outlet 44 of the pump 10 occurs because the volume of each working chamber 50 changes as it passes from the fluid inlet 42 to the fluid outlet 44, thereby increasing the pressure of the fluid. Thus, the fluid inlet 42 is the low pressure side of the pump 10, and the fluid outlet 44 is the high pressure side of the pump 10. Pivoting of the pump control ring 28 is operable to vary the amount of volumetric change of each working chamber 50 during rotation, which in turn changes the volumetric displacement of the pump 10. In particular, the pump control ring 28 pivots between a first position (FIG. 3) and a second position (FIG. 4). The first position corresponds to a maximum volumetric capacity of the pump 10. In the first position, the pump control ring 28 has reached its end limit of travel in a clockwise direction with respect to the pivot pin 30 by engagement of the pump control ring 28 with the housing 14. The second position corresponds to a minimum volumetric capacity of the pump 10. In the second position, the pump control ring 28 has reached its end limit of travel in a counter-clockwise direction with respect to the pivot pin 30. The volumetric capacity of the pump varies continuously as a function of the position of the pump control ring 28, which under working conditions, often will be disposed somewhere between the first position and the section position.

A spring chamber 40 and a control chamber 41 are defined within the housing 14 to regulate the position of the pump control ring 28. A first seal 46 and a second seal 48 are mounted within respective recesses in the pump control ring 28 and engage an inner surface of the housing 14 so as to seal the pump control ring 28 with respect to the inner surface of the housing 14 to define the spring chamber 40 and the control chamber 41.

The spring chamber 40 is formed within a space that is disposed outward of the pump control ring 28, between the pump control ring 28 and an interior surface of the housing 14. The first side 64 of the regulating member 62 faces the spring chamber 40. The volume of the spring chamber 40 changes based on the position of the pump control ring 28, given that the regulating member 62 moves with the pump control ring 28. The spring chamber 40 is at a maximum volume when the pump control ring 28 is in the first position. The volume of the spring chamber 40 decreases as the pump control ring 28 moves toward the second position, and reaches a minimum volume when the pump control ring 28 is in the second position.

The control chamber 41 is formed within a space that is disposed outward of the pump control ring 28, between the pump control ring 28 and an interior surface of the housing 14. The second side 66 of the regulating member 62 faces the control chamber 41. The volume of the control chamber 41 changes based on the position of the pump control ring 28, given that the regulating member 62 moves with the pump control ring 28. The control chamber 41 is at a minimum volume when the pump control ring 28 is in the first position. The volume of the control chamber 41 increases as the pump control ring 28 moves toward the second position, and reaches a maximum volume when the pump control ring 28 is in the second position.

A biasing element, such as a compression spring 52 is operable to urge the pump control ring 28 toward the first position. In the illustrated example, the compression spring 52 is located in the spring chamber 40. One end of the compression spring 52 engages the housing 14, and the other end of the compression spring 52 engages the first side 64 of the regulating member 62. The biasing force exerted on the regulating member 62 thus urges the pump control ring 28 toward the first position. Other biasing elements can be utilized to urge the pump control ring 28 toward the first position. As one example, a torsion spring could be connected to the pump control ring 28. As another example, a tension spring could be utilized. As another example, a compression spring could be used but located other than within the spring chamber 40.

The position of the pump control ring 28, and thus the volumetric displacement of the pump 10, is regulated by the fluid pressure within the control chamber 41 and the biasing force that is exerted upon the pump control ring 28 by the compression spring 52. The biasing force exerted by the compression spring 52 urges the pump control ring toward the first position. The fluid pressure within the control chamber 41 acts counter to the biasing force exerted by the compression spring 52, to urge the pump control ring 28 toward the second position.

A first supply path 68 provides pressurized fluid to the fluid inlet 42. This can be done directly, by routing the first supply path directly to the fluid inlet 42, or indirectly, by routing the first supply path 68 to another portion of the pump 10 that is in fluid communication with the fluid inlet 42 and is at equilibrium with the fluid inlet 42. In the illustrated example, the first supply path 68 is formed in the housing 14 and is in fluid communication with the spring chamber 40, which is in fluid communication with the fluid inlet 42 and is at equilibrium with the fluid inlet 42. In an alternative implementation, the first supply path can be connected to the oil sump reservoir 12, which is also in fluid communication with the fluid inlet 42 and is at equilibrium with the fluid inlet 42.

A second supply path 70 provides pressurized fluid to the control chamber 41. The second supply path 70 can be formed in the housing 14 and is in fluid communication with the control chamber 41.

Figure 5:
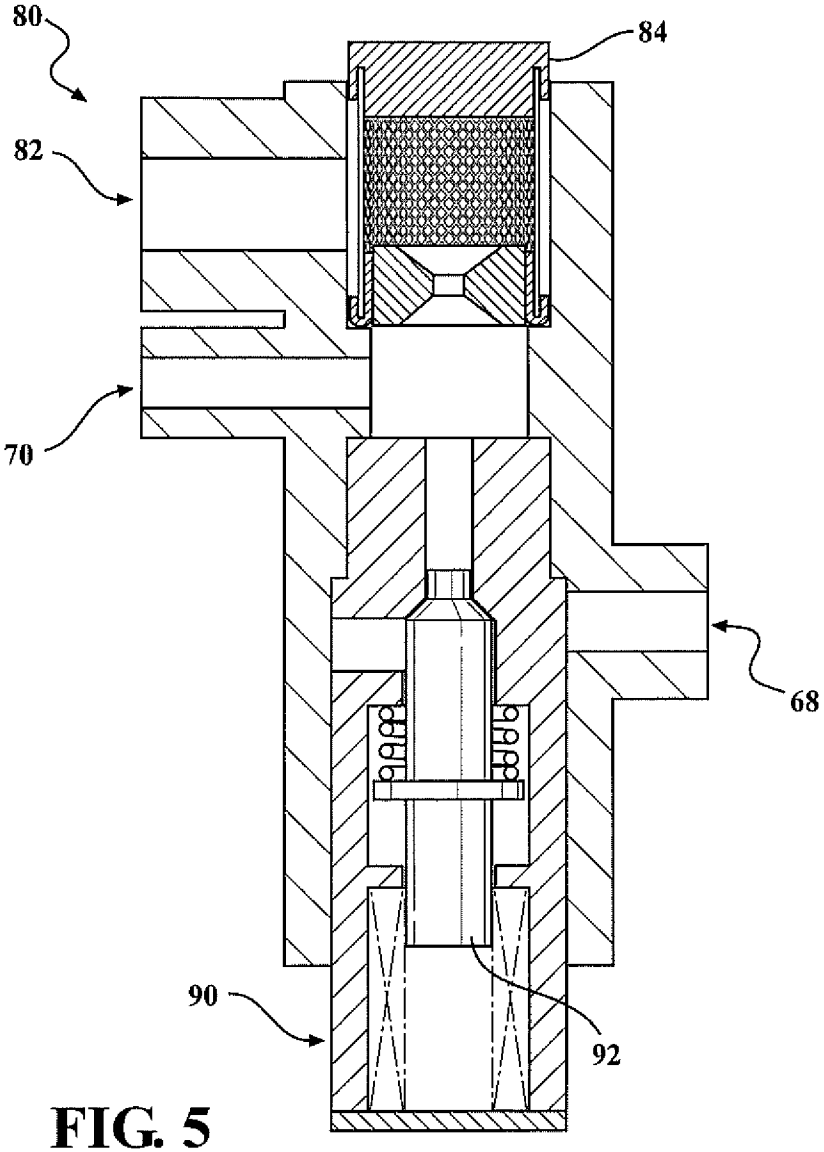
FIG. 5 is a cross-section view showing a feedback circuit assembly.

FIG. 5 shows a feedback circuit assembly 80 that supplies the pressurized fluid to the first supply path 68 and the second supply path 70. The feedback circuit assembly 80 can be defined in part by the housing 14, or can be formed separately. The feedback circuit assembly 80 receives the pressurized fluid via a feedback path 82. The feedback path 82 is in fluid communication with the fluid outlet 44 of the pump 10, and thus, receives the pressurized fluid at the outlet pressure of the pump 10.

Figure 6:
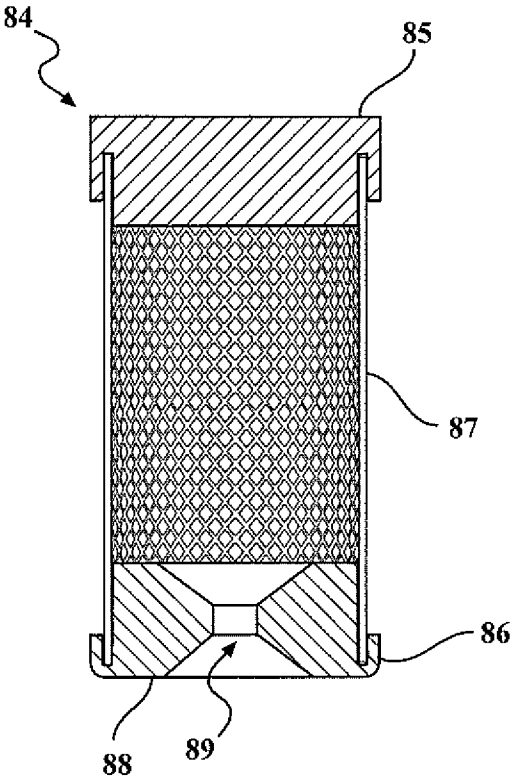
FIG. 6 is a cross-section view showing a restrictor module of the feedback circuit assembly.

The feedback circuit assembly 80 includes a restrictor module 84, as shown in FIG. 6, which is located downstream from the feedback path 82. The restrictor module 84 includes a top cap 85 and a bottom cap 86 that are connected to and spaced apart by a cylindrical filter element 87 that is operable to filter the pressurized fluid. The filter element 87 can be a thin-walled cylindrical structure formed of, for example, a mesh material that is operable to remove at least some contaminants from the pressurized fluid. The bottom cap 86 is a tubular member that has a restrictor element 88 seated in its axial bore. The restrictor element 88 is operable to control the amount of fluid that passes through it, by forcing the fluid to pass through a calibrated orifice 89. Thus, a pressure drop occurs across the restrictor element 88, such that the pressure of the pressurized fluid along the first supply path 68 and the second supply path 70 is less than the outlet pressure of the pump 10. The calibrated orifice 89 is configured such that the pressure of the pressurized fluid along the first supply path 68 and the second supply path 70 remains higher than the inlet pressure of the pump 10.

With further reference to FIG. 5, the second supply path 70 is in communication with the feedback circuit assembly immediately downstream of the restrictor element 88. Thus, the second supply path 70 receives the pressurized fluid at the pressure determined by the restrictor element 88 to provide the pressurized fluid to the control chamber 41. In the illustrated implementation, the second supply path 70 is in fluid communication with the fluid outlet 44 of the pump 10 via the restrictor element 88 and the feedback path 82 without interposition of valves. Thus, the fluid pressure in the control chamber 41 is at least in part a function of the speed of the pump 10.

Downstream of the restrictor element 88 and the second supply path 70, a valve 90 is provided to regulate flow of the pressurized fluid to the first supply path 68 to thereby control the fluid pressure in the control chamber 41. When the valve 90 is closed, the pressure in the control chamber 41 is at equilibrium with the pressure across the restrictor element 88. When the valve 90 is partly or fully open, the fluid pressure within the control chamber 41 is lower than the pressure across the restrictor element 88, as the pressurized fluid returns to the inlet side of the pump via the first supply path 68. Accordingly, moving the valve 90 from the closed position toward an open position decreases the fluid pressure within the control chamber 41, while moving the valve 90 from the open position toward the closed position increases the fluid pressure within the control chamber 41.

The valve 90 includes a valve member 92 that is movable between a fully open position and a fully closed position. In the fully open position, supply of the pressurized fluid to the spring chamber 40 is not restrained by the valve 90. In the fully closed position, supply of the pressurized fluid to the spring chamber 40 is prevented. In some implementations, the valve 90 is a non-proportional valve that moves between the fully open position and the fully closed position but is incapable of establishing intermediate positions between the fully open and fully closed positions. In other implementations, the valve 90 is a proportional valve that is operable to define a range of positions between the fully open position and the fully closed position to thereby vary the flow of the fluid to the spring chamber 40 and thereby regulate pressure in the control chamber 41.

Figure 7:
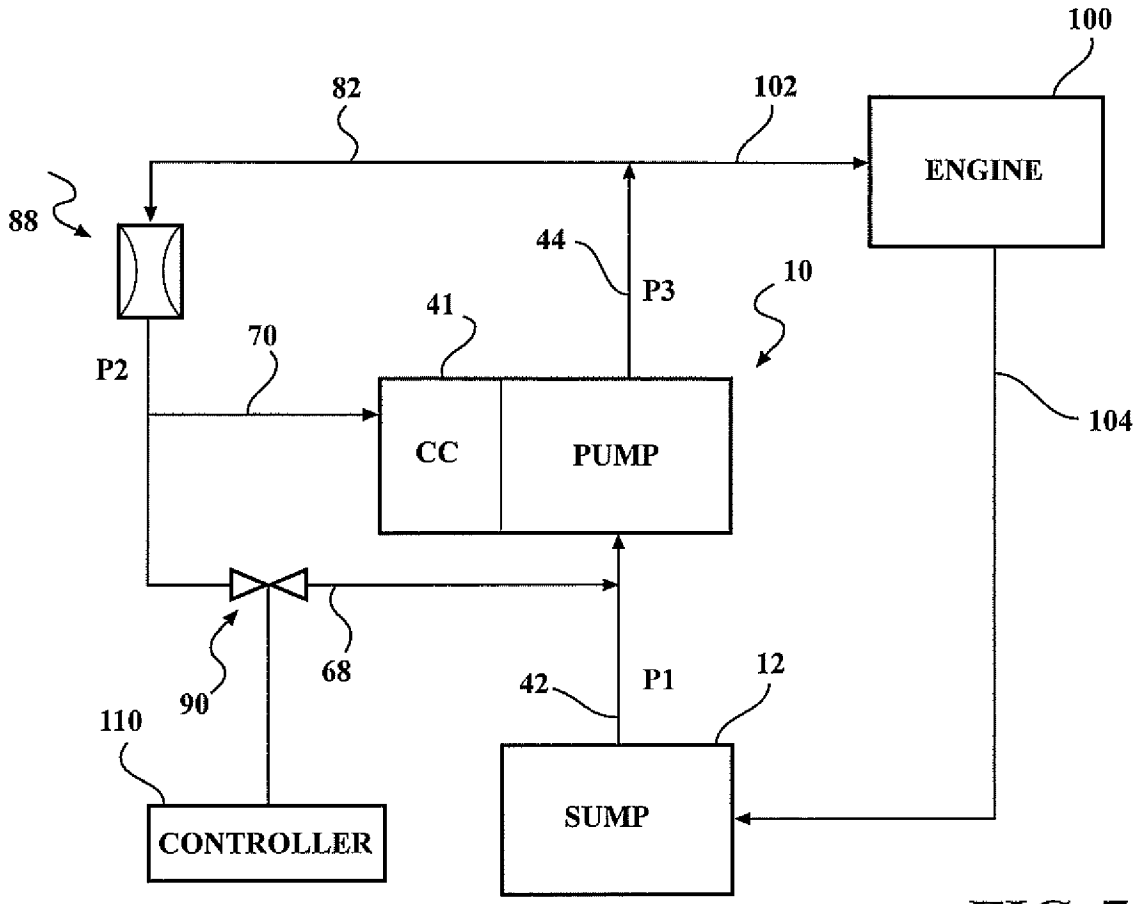
FIG. 7 is a diagram showing the pump incorporated in a lubricating system of an automobile engine.

FIG. 7 is a diagram showing the pump 10 incorporated in a lubricating system of an automobile engine 100. The pump 10 receives fluid, such as oil, from the oil sump reservoir 12 at an inlet pressure P1 via the fluid inlet 42 of the pump 10. The pump 10 increases the pressure of the fluid to an outlet pressure P3, and the fluid exits the pump 10 at the fluid outlet 44. The fluid travels from the fluid outlet 44 of the pump 10 to the automobile engine 100 via a supply circuit 102 and is subsequently returned to the oil sump reservoir 12 via a return circuit 104. A portion of the fluid at the outlet pressure P3 is diverted from the fluid outlet 44 of the pump 10 to the restrictor element 88. The restrictor element drops the pressure of the fluid to a control pressure P2, where P3>P2>P1. A portion of the fluid is delivered to the control chamber 41 via the second supply path 70. If the valve 90 is in the closed position, the control chamber 41 equilibrates to the control pressure P2. If the valve 90 is partially open or fully open (i.e. in the open position), a portion of the fluid is delivered to the inlet side of the pump 10, such as to the spring chamber 40 via the first supply path 68. The valve 90 can permit, impede, or prevent flow of the fluid at the control pressure P2 to the inlet side of the pump 10, dependent upon the position of the valve 90, in order to change the pressure within the control chamber 41. With the valve 90 open, the fluid pressure within the control chamber 41 is lower than the control pressure P2. This allows the biasing element 52 to move the pump control ring 28 to the first position, thereby maximizing the volumetric output of the pump 10. When the valve 90 is partially or fully closed, the pressurized fluid at the control pressure P2 is no longer able to flow unimpeded to the low pressure inlet side of the pump 10, and thus, the pressure within the control chamber 41 increases. As a result, the pump control ring 28 is rotated toward the second position, thereby decreasing the volumetric output of the pump 10.

The valve 90 can be an electronically-controlled valve, where the position of the valve 90 is regulated by a control signal that is received via electronic communication with a controller 110, such as an engine control unit (ECU). The controller 110 can be a programmable device having a processor that is operable to execute program instructions that cause the controller 110 to issue control signals for regulating operation of the valve 90. Alternatively, the controller 110 can be a non-programmable electronic device configured to issue the control signals.

Figure 8:
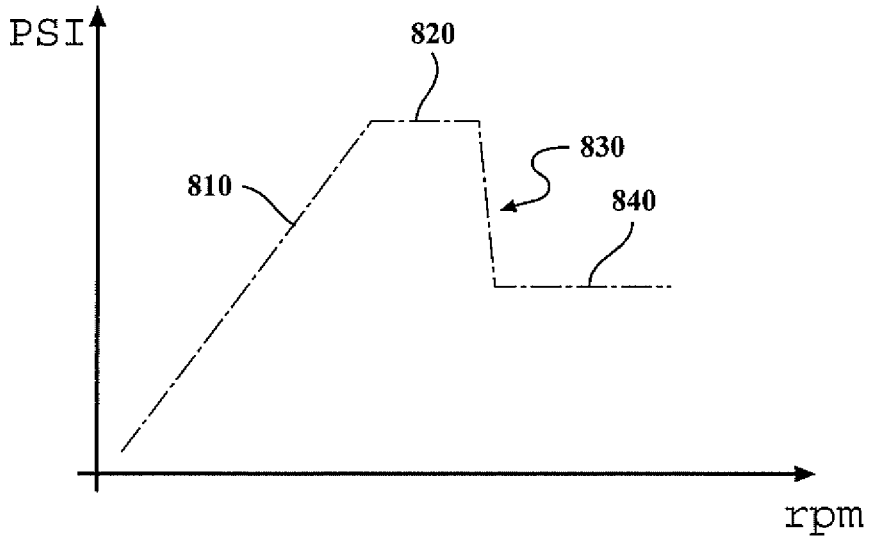
FIG. 8 is a graph showing flow rate relative to pump speed in a first example where the valve is a two position valve.

FIG. 8 is a graph showing flow rate relative to pump speed in a first example where the valve 90 is a two position valve that is operable to define the fully open and fully closed positions but is not selectively positionable at intermediate positions between the fully open position and the fully closed position. Initially, in segment 810, the valve 90 is in the fully open position, and the pump control ring 28 is in the first position. The pressure in the control chamber 41 is not sufficient to overcome the force of the compression spring 52, and the pump control ring 28 remains in the first position. At segment 820, as the pump 10 reaches its maximum output. At segment 830, the valve 90 is moved from the fully open position to the fully closed position. This causes the fluid pressure in the control chamber 41 to increase, thereby moving the pump control ring 28 toward the second position. With the pump control ring 28 in the second position, the volumetric capacity of the pump 10 is decreased at segment 840 relative to segment 820.

Figure 9:
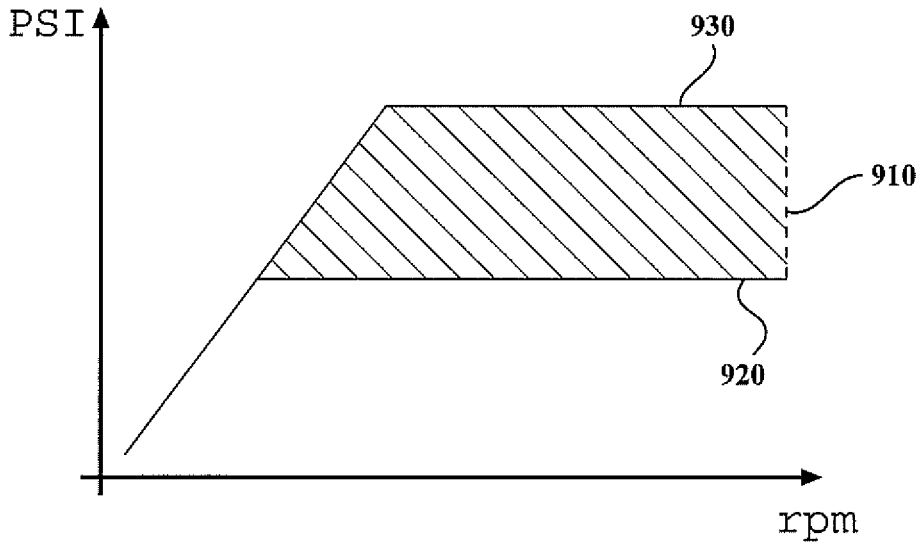
FIG. 9 is a graph showing flow rate relative to pump speed in a second example where the valve is a proportional valve.

FIG. 9 is a graph showing flow rate relative to pump speed in a second example where the valve 90 is a proportional valve that is selectively positionable at intermediate positions between the fully open position and the fully closed position. Operation of the pump 10 is as described with respect to FIG. 8, except that the position of the valve 90 can be adjusted incrementally between the fully open and fully closed positions. This allows the volumetric output of the pump to be modulated within a range 910 between a low level 920 and a high level 930. The low level 920 corresponds to the fully closed position of the valve 90, and the high level 930 corresponds to the fully open position of the valve 90.

While the description has been made in connection with what is presently considered to be the most practical and preferred embodiment, it is to be understood that the invention is not to be limited to the disclosed embodiments, but to the contrary, it is intended to cover various modifications and equivalent arrangements included within the spirit and scope of the appended claims. The scope is to be accorded the broadest interpretation so as to encompass all such modifications and equivalent structures as is performed under the law.

The invention claimed is:

1. A variable displacement vane pump comprising:

a housing including a fluid inlet and a fluid outlet;

a fluid pressurization assembly positioned within the housing;

a feedback path in communication with the fluid outlet for supplying pressurized fluid;

a first supply path in communication with the feedback path and the fluid inlet for providing the pressurized fluid from the feedback path to the fluid inlet;

a second supply path in communication with the feedback path and the fluid pressurization assembly for providing the pressurized fluid from the feedback path to the fluid pressurization assembly, the first supply path and the second supply path being separate such that the first supply path and the second supply path do not communicate with one another; and a restrictor element that receives the pressurized fluid from the feedback path and causes the pressure of the pressurized fluid to drop before it reaches the first supply path and the second supply path.

2. A variable displacement vane pump comprising:

a housing including a fluid inlet and a fluid outlet;

a control member positioned within the housing to alter displacement of the pump;

a rotor rotatably mounted in relation to the control member to pressurize fluid as the fluid moves from the fluid inlet to the fluid outlet;

a feedback path in communication with the fluid outlet for supplying a pressurized fluid;

a first supply path in communication with the feedback path and the fluid inlet for providing the pressurized fluid from the feedback path to the fluid inlet;

a second supply path in communication with the feedback path and the control member for providing the pressurized fluid from the feedback path to the control member, the first supply path and the second supply path being separate such that the first supply path and the second supply path do not communicate with one another; and a restrictor element that receives the pressurized fluid from the feedback path and causes the pressure of the pressurized fluid to drop before it reaches the first supply path and the second supply path.

3. The variable displacement vane pump of claim 2, wherein the restrictor element is located downstream from the feedback path.

4. The variable displacement vane pump of claim 3, wherein the second supply path is located downstream from the restrictor element.

5. The variable displacement vane pump of claim 4, further comprising a valve positioned to control flow of the pressurized fluid via the second supply path.

6. The variable displacement vane pump of claim 5, wherein the valve is movable between open and closed positions to increase the fluid pressure, the valve being located downstream from the second supply path.

7. The variable displacement vane pump of claim 6, wherein the first supply path is located downstream from the valve.

8. A variable displacement vane pump having a housing with a pump chamber having a fluid inlet and a fluid outlet, a pump control ring disposed within the housing for altering the displacement of the pump by rotating between a first position that corresponds to a maximum volumetric capacity of the pump and a second position that corresponds to a minimum volumetric capacity of the pump, a vane pump rotor rotatably mounted within the pump control ring, and the vane pump rotor having a plurality of slidably mounted vanes engaging an inside surface of the pump control ring, the vane pump rotor having an axis of rotation eccentric from a center of the pump control ring, the vane pump rotor rotating to pressurize fluid as the fluid moves from the fluid inlet to the fluid outlet, comprising:

a biasing element for urging the control ring toward the first position;

a control chamber formed between the housing and the pump control ring, wherein fluid pressure within the control chamber urges the control ring toward the second position;

a feedback path in communication with the fluid outlet for supplying a pressurized fluid;

a first supply path in communication with the feedback path and the fluid inlet for providing the pressurized fluid from the feedback path to the fluid inlet;

a second supply path in communication with the feedback path and the control chamber for providing the pressurized fluid from the feedback path to the control chamber;

a valve for controlling flow of the pressurized fluid via the second supply path, wherein the valve moves between a fully open position in which flow of the pressurized fluid along the first supply path is not restrained by the valve and a fully closed position in which flow of the pressurized fluid along the first supply path is prevented by the valve, and moving the valve from the open position to the closed position increases the fluid pressure within the control chamber; and a restrictor element that receives the pressurized fluid from the feedback path and causes the pressure of the pressurized fluid to drop before it reaches the first supply path and the second supply path, wherein the restrictor element is located downstream from the feedback path, the second supply path is located unidirectionally downstream from the restrictor element, the valve is located unidirectionally downstream from the second supply path, and the first supply path is located downstream from the valve.

9. The variable displacement vane pump of claim 8, wherein the valve is a non-proportional valve.

10. The variable displacement vane pump of claim 8, wherein the valve is biased towards the open position.

11. The variable displacement vane pump of claim 8, wherein the valve is a proportional valve that is operable to define a range of positions between the fully open position and the fully closed position.

12. The variable displacement vane pump of claim 8, wherein the pressurized fluid is supplied to the control chamber at a pressure that is less than an outlet pressure of the pump and greater than an inlet pressure of the pump.

13. The variable displacement vane pump of claim 8, wherein the restrictor element includes a calibrated orifice.

14. The variable displacement vane pump of claim 8, wherein the valve is an electronically-controlled valve.

15. The variable displacement vane pump of claim 14, further comprising:

a controller that is in electrical communication with the valve for providing a control signal to the valve.

16. The variable displacement vane pump of claim 8, wherein the biasing element is a spring.

17. The variable displacement vane pump of claim 8, wherein the biasing element is located in a spring chamber formed between the housing and the pump control ring.

18. The variable displacement vane pump of claim 17, wherein the control ring includes a regulating member that extends outward from a generally circular portion of the control ring, the regulating member having a first side that faces the control chamber and a second side that faces the spring chamber.

19. The variable displacement vane pump of claim 18, wherein the fluid pressure in the control chamber urges the control ring toward the second position by acting on the second side of the regulating member.

20. The variable displacement vane pump of claim 19, wherein the biasing element urges the control ring toward the first position by engaging the first side of the regulating member.

* * * * *